United States Patent [19]

Lefevre et al.

[11] Patent Number: 4,513,290

[45] Date of Patent: Apr. 23, 1985

[54] NON-RESONANT COAXIAL MONOPOLE ANTENNA

[75] Inventors: Donald K. Lefevre; Patrick W. Dennis, both of Salt Lake City; Dennis F. Seegmiller, Kaysville, all of Utah

[73] Assignee: Sperry Corporation, New York, N.Y.

[21] Appl. No.: 488,485

[22] Filed: Apr. 25, 1983

[51] Int. Cl.[3] ..... H01Q 9/02; H01Q 9/38

[52] U.S. Cl. ..... 343/745; 343/830; 343/791; 343/873; 343/861

[58] Field of Search ..... 343/722, 745, 749, 790, 343/791, 873, 850–852, 860–862, 905, 900, 792

[56] References Cited

U.S. PATENT DOCUMENTS

| | | | |
|---|---|---|---|
| 2,567,260 | 9/1951 | Wiley | 343/830 |
| 3,358,286 | 12/1967 | Heins | 343/831 |
| 3,582,952 | 6/1971 | Heins | 343/830 |
| 4,008,477 | 2/1977 | Babij et al. | 343/873 |

*Primary Examiner*—E. Lieberman

*Assistant Examiner*—Michael C. Wimer

*Attorney, Agent, or Firm*—John B. Sowell; Kenneth T. Grace; Marshall M. Truex

[57] ABSTRACT

A relatively short broad band monopole coaxial antenna is provided with a center conductor and an outer radiator. The antenna is mounted above a ground plane and comprises a bare outer radiator portion adjacent the ground plane and a portion remote from the ground plane which is covered with a variable thickness microwave absorbent material. The signal to be transmitted is applied to the base of the monopole antenna adjacent the ground plane. Non-radiated signals propagate up the antenna. The high frequency components are absorbed by the microwave absorbing material. A tip matching network and a base matching network are coupled between the outer conductor and the ground plane for attenuating and matching the low frequency components of the non-radiated signals. The resulting monopole coaxial antenna has no undesirable reflections and has the appearance of infinite effective length antenna.

17 Claims, 7 Drawing Figures

NON-RESONANT COAXIAL MONOPOLE ANTENNA

BACKGROUND OF THE INVENTION

1. Field of the Invention

This invention, relates to a non-resonant monopole antenna having a ground plane. More particularly, this invention relates to a monopole antenna which has a relatively short length and provides a broad band antenna with an effective length of an infinitely long antenna.

2. Description of the Prior Art

Monopole antennas having associated ground planes are known. Such monopole antennas are also known to have a relatively narrow bandwidth which is caused by reflections of the signals being applied to the antenna.

Dipole antennas which do not have associated ground planes are well known. Such dipole antennas are also known to have a relatively narrow bandwidth which is also caused by reflections of the signals being applied to the relatively short length of antenna.

Motohisa Kanda disclosed a broad band antenna in "IEEE Transactions on Antennas and Propagation", Vol. AP-26, No. 3, May, 1978 at pages 439 to 447. The antenna disclosed in this article comprised a nonconducting cylinder on which had been deposited a varying-conductivity resistive film. To achieve a flat frequency response curve, it was necessary to calculate the thickness of the film along the length of the cylinder using the "method of moments" approach. The resulting thin film antenna requires a complex calculation and deposition, yet does not always achieve the desired response.

Motohisa Kanda also disclosed a broad band antenna in the magazine "Microwaves", January, 1981 issue, at pages 63 to 66. The dipole antenna disclosed in this article was resistively loaded and also comprised a thin film of resistive alloy deposited on a glass rod. The thickness of the thin film necessary to achieve a desired bandwidth was also calculated by the "method of moments" approach.

While resistively loaded antennas will provide a broad band antenna, such antennas are difficult to make and there is no provision for making any final adjustment to imperfections in the response curves. Further, such resistive film antennas do not provide any means for selectively eliminating frequencies within the broad band being propagated.

It would be extremely desirable to provide a relatively short monopole antenna which has a substantially flat response curve and which can be adjusted for imperfections in the response curve to enhance or eliminate predetermined frequencies within the broad band of frequencies and to provide a broad band antenna which has an infinite effective length over a broad band of frequencies.

SUMMARY OF THE INVENTION

It is a principal object of the present invention to provide a fractional wavelength coaxial monopole antenna which has an infinite effective length over a broad band of fre- quencies.

It is another principal object of the present invention to provide an antenna which is simple to manufacture and provides means for adjusting the response curve.

It is another principal object of the present invention to provide a novel antenna which has microwave absorbing material applied to the outside of a portion of a coaxial antenna to provide a broad frequency response.

It is yet another object of the present invention to provide a plurality of matching networks associated with a broad band monopole coaxial antenna so as to provide adjustment for obtaining desired frequency responses to the response curve of the antenna.

It is a general object of the present invention to provide a relatively short fractional wavelength coaxial antenna which may be ruggedly constructed and made for airborne purposes.

According to these and other objects of the present invention, there is provided a monopole coaxial antenna having a center conductor and an outer radiator. The antenna has an associated ground plane. An end portion of the coaxial antenna remote from the ground plane is provided with a predetermined shaped variable thickness microwave absorbent material. The broad band input signals to be transmitted on the antenna are electrically connected to the bare outer radiator. The signals propagate up the bare outer radiator where the high frequency components of the broad band frequencies are attenuated by the microwave absorbing material. The low frequency components of the broad band signals are passed through a tip matching network and return down the center conductor of the coaxial antenna where they are passed through a base matching network before being coupled to the ground plane. The tip matching network and the base matching network are designed to provide impedence matching with the antenna system so as to eliminate substantially all reflections of signals that are applied to the antenna so as to provide a relatively short monopole antenna having the appearance of an infinite effective length antenna.

DESCRIPTION OF THE PREFERRED EMBODIMENT

Figure 1:
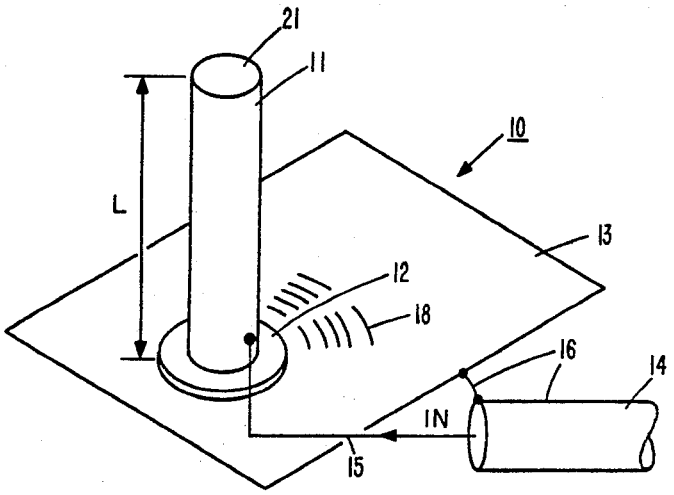
FIG. 1 (PRIOR ART)
FIG. 1 is a schematic isometric drawing of a simple prior art monopole antenna mounted on a ground plane.

Refer now to FIG. 1 showing a simplified monopole antenna of the type known in the prior art. The monopole antenna 10 comprises an antenna element 11 which may be a solid conductive rod or a conductive cylinder on an insulating rod. The antenna element 11 is mounted on an insulating washer 12 which separates it from the ground plane 13. The signal to be applied to the antenna element 11 is applied from a coaxial line 14 which has the center conductor 15 connected to the base of the element 11 and the outer shield 16 is connected to the ground plane 13. It is well known that the antenna system 10 is a narrow band antenna system and has a resonant frequency wavelength lambda which is equal to 4L.

Figure 2:
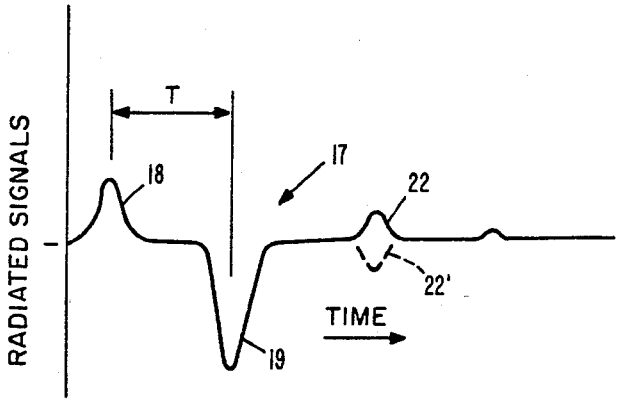
FIG. 2 (PRIOR ART)
FIG. 2 is a schematic diagram of the radiated signal waveform that is associated with the antenna of FIG. 1.

Refer now to FIG. 2 which is a schematic drawing showing the radiated signal waveform associated with the monopole antenna of FIG. 1. The signal applied on center conductor 15 is applied at the base of the antenna element 11 to initially cause radiation of the signal as shown by the base radiated signal pulse 18. The non-radiated portion of signal 18 propagates up the length of the monopole antenna 11 and forms a reflected signal at the tip or end 21 which causes a tip radiated signal 19 that is twice the magnitude of the original base radiated signal 18. This reflected signal now propagates down the length of the monopole antenna 11 and generates a base reflected radiated signal 22 or 22' depending on the mismatch at the base of the element 11. The signals continue to be radiated and reflected from the base and the tip until they are completely damped out. It will be noted that the time T between the original radiation signal 18 and the tip radiation signal 19 is the time taken for the signal to propagate up the length L of the monopole 11. The length L of the antenna is one quarter of the wavelength of the frequency at which the monopole antenna system 10 resonates.

Figure 3:
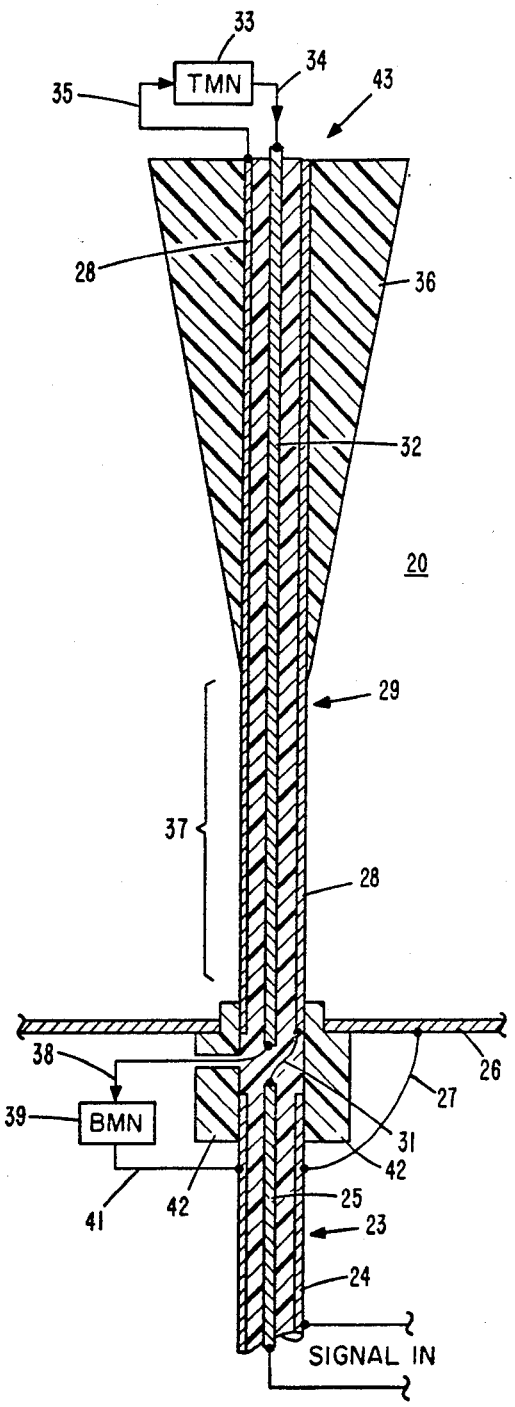
FIG. 3 is a schematic drawing in cross-section elevation of the novel monopole antenna of the present invention.

Refer now to FIG. 3 showing a schematic diagram of the present invention novel monopole antenna system 20. The coaxial cable input line 23 is shown comprising an outer shield 24 and a center conductor 25. The outer shield 24 is connected to ground plane 26 by means of a connecting line 27. The center conductor 25 is connected to the outer radiator 28 of coaxial antenna 29 by means of a line 31. The center conductor 32 of coaxial antenna 29 is shown connected to a tip matching network 33 via line 34. The tip matching network is coupled via line 35 to the outer radiator 28 of the coaxial antenna 29. The upper end portion of the coaxial antenna 29 is covered with a microwave absorbing material 36 which is in moldable and castable form and can be formed on the antenna 29. The portion of the antenna 29 immediately above the ground plane 26 comprises the bare portion or radiating portion 37 of the antenna 29. A line 38 is connected to the center conductor 32 of antenna 29 and is coupled to the base matching network 39. The base matching network 39 is coupled via line 41 to the outer shield 24 of the input line 23. It will be noted that the outer shield 24 is directly coupled to the ground plane 26 thus the base matching network 39 is also coupled to the ground plane 26. In order to properly support and isolate the input coaxial line 23 and the coaxial antenna 29, there is provided a shaped insulating support 42 which may have any desired shape to isolate the outer radiator 28 from the ground plane 26 and to also isolate the input line 23 from the antenna 29 as well as the ground plane 26.

The signal to be radiated is applied to the center conductor 25 of the input cable 23. The signal is coupled to the outer radiator 28 of the bare portion 37 of the antenna 29. The input signal is radiated from the base portion of the antenna 29 similar to a standard monopole system. The radiated signal propagates up the bare portion 37 of the antenna 29 and reaches the portion of the antenna 29 covered by the microwave absorbing material 36. The high frequency signals are absorbed by the microwave absorbing material 36 and are substantially eliminated before they reach the tip 43 of the antenna 29. The low frequency signals of the applied signal are still present at the tip 43 and are conducted via line 35 to the tip matching network 33 where they are filtered and returned via line 34 to the center conductor 32. The low frequency signals on center conductor 32 are now conducted via line 38 to the base matching network 39 and are further filtered by the base matching network 39. The output of base matching network 39 is applied to the shield 24 of input line 23 via line 41 where it is coupled to the ground plane 26. Having explained how the high frequency signals are attenuated and substantially eliminated by the absorbing material 36, it will be understood that no reflected signal in the high frequency range is available at the tip 43 to be reflected back toward the base matching network 39. Thus, the low frequency signals which are attenuated by the tip matching network 33 but are not completely eliminated are conducted back toward the ground plane 26 and to the base matching network 39 which forms an attenuation network and a matching network for elimination of the undesirable low frequency signals.

Figure 4:
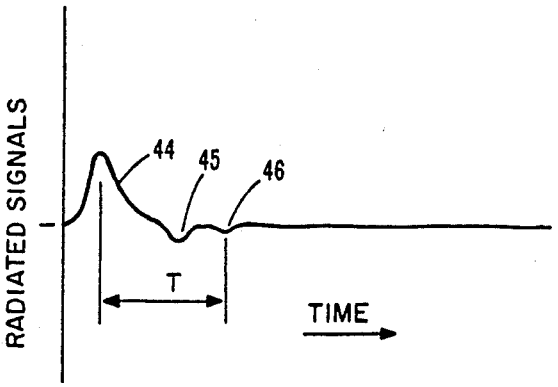
FIG. 4 is a schematic diagram of the radiated signal waveform that is associated with a novel antenna of FIG. 3.

Refer now to FIG. 4 which is a schematic diagram of the radiated signal waveform that is associated with the novel antenna of FIG. 3. The first radiation signal 44 is similar to the aforementioned signal 18, and is also being radiated from the outer radiator 28. The signal 44 forms an overshoot 45 at the base. The non-radiated signal which now reaches the tip 43 of the antenna 29, causes a reflected signal 46 which is much less than the magnitude of the signal 19. If it is possible to obtain a perfect match for the input signal, there will be no reflected signal 46 in the present system 20. The signals illustrated at 45, 46 are exaggerated to more clearly explain the actual results which are obtained in actual practice using broad band coaxial antennas.

The present invention offers three different ways of making desired adjustments to the novel antenna system. Assuming that the microwave absorbing means 36 is an extremely efficient filter for eliminating the high frequency components of the broad band, then the remaining low frequencies which must be attenuated may be attenuated by adjustment of the tip matching network 33 before the signal is returned down the center conductor to the base matching network 39. The base matching network may also be adjusted so as to form an impedence matching network as well as performing filtering of undesired frequencies. In the preferred embodiment shown it is desired that the combination of the tip matching network 33 and the base matching network 39 form a characteristic impedence which is equal to the characteristic impedence of the antenna system 20. When the characteristic impedences of the system 20 and the antenna are matched, there is perfect damping of the low frequency components. The shape of the microwave absorbing material 36 may be formed in a tapered shape, a conical shape, an exponential shape or combinations of geometric shapes. Preferably, the shape of the absorbing material 36 is not formed to have an abrupt change which could cause a resonant frequency.

Figure 5:
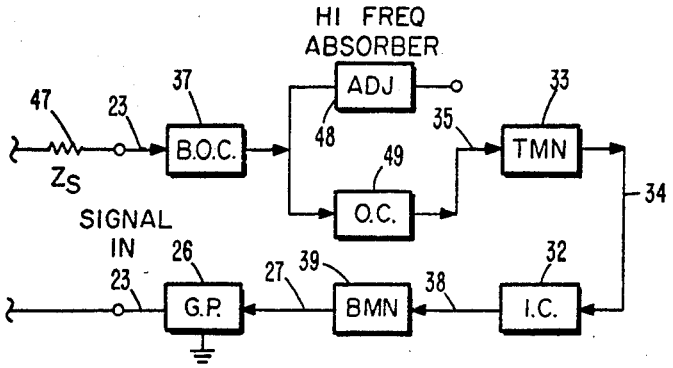
FIG. 5 is a schematic block diagram of an equivalent circuit of the novel antenna shown in FIG. 3.

Refer now to FIG. 5 which is a schematic block diagram of an equivalent circuit of the novel antenna system 20 shown in FIG. 3. The source of the input signal has a source impedence 47. The signal is applied through the aforementioned coaxial input line 23 to the outer radiator or bare outer radiator 37 of the coaxial antenna 29. The signal applied to the bare outer radiator 37 is attenuated by the absorbing means 36 shown as the equivalent impedence 48 The portion of the outer conductor 28 which is under the absorbing means 26 is shown by block 49. The high frequency components of the signal are being attenuated by the high frequency absorber 48 and the low frequency component of the signal are being conducted to the tip through the outer conductor 49. The outer conductor 49 is connected via line 35 to the tip matching network 33 and the tip matching network 33 is connected via line 34 to the inner conductor 32 as explained hereinbefore. The low frequency components of the broad band signal may be attenuated by the tip matching network 33 and the remaining signals are applied to the inner conductor 32 where they are coupled via line 38 to the base matching network 39 where they may be further attenuated. Not only are the remaining signals attenuated, but they may be matched and filtered to achieve any desired frequency response. The base matching network 39 is coupled to the ground plane 26 via the line 27, which may be only a portion of the shield 24 of the coaxial cable 23.

Having explained the equivalent circuit shown in FIG. 5, it will be understood that the high frequency absorber 48 is an adjustable element. Further, the tip matching network 33 and the base matching network 39 are also adjustable elements. Accordingly, it is not necessary to explain how these filters and matching networks may be employed simultaneously to achieve desired broad band frequency responses.

Figure 6:
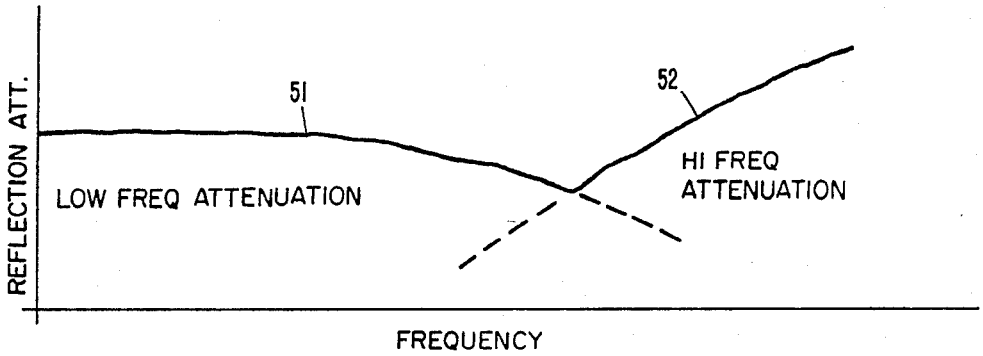
FIG. 6 is a schematic diagram of the reflected attenuated signal waveform that is associated with the antenna of FIG. 3.

Refer now to FIG. 6 which is a schematic diagram of the reflection attenuated signal waveform that is associated with the novel antenna shown in FIG. 3. Curve 51 is representative of the attenuation which is the result of and the effect of the low frequency components of the broad band signal being attenuated by the tip matching network 33 and the base matching network 39. Thus, it will be understood that since these signals have been attenuated by these networks, they cannot cause undesirable radiation. Similarly, curve 52 is representative of the effective attenuation that is accomplished by the high frequency absorber 48 shown in FIG. 5 and/or the microwave absorbing material 36 shown in FIG. 3. FIG. 6 is a schematic representation not drawn to scale and is included to more clearly explain the attenuation concept.

Figure 7:
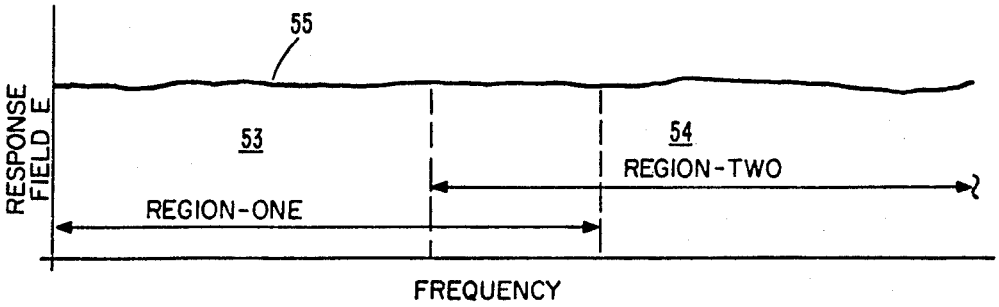
FIG. 7 is a schematic diagram of the response curve showing the regions where the undesirable reflection signals are being eliminated.

Refer now to FIG. 7 which is a schematic diagram of the response curve showing the regions where the undesirable reflection signals are being eliminated. The region one portion numbered 53 is representative of the portion of the broad band of frequencies where the reflections are being eliminated by the tip matching network 33 and the base matching network 39. The region two portion numbered 54 is the high frequency portion of the broad band spectrum where the reflections are being eliminated by the high frequency absorber 48 (36). FIG. 7 illustrates that the elimination of the low frequency reflections and the high frequency reflections in the regions one and two result in a flat frequency response curve 55 and a substantially uniform radiated output over a desired broad frequency range.

The preferred embodiment monopole antenna and its associated ground plane will produce a 3DB greater directivity as compared with a dipole. The efficiency of the preferred embodiment of the present invention, was tested employing a novel coaxial monopole antenna approximately fourteen inches in length. The coaxial antenna had applied thereon conical absorbing means approximately ten inches in length. This broad band antenna was tested by applying a broad band signal embracing the frequencies from ten megahertz to three gigahertz. The radiated signal was received and measured by sensitive measuring means and no appreciable distortion was observed indicating that the response over this broad range of frequencies was substantially flat. Microwave absorbent material such as ECCOSORB (TM) CR-S-124 available from Emerson and Cuming, Canton Mass. was found to attenuate high frequency signals from 5.6 decibels (DB) per centimeter to 63 decibels per centimeter of length in the frequency range of 1.5 gigahertz to 8.6 gigahertz. Such materials perform the function of highly complex attenuation networks and are frequency dependent. While the base matching means 39 and tip matching means 33 provides means for impedence matching and signal dissipation, it should be understood that the system 20 is operable without one of the matching means over a broad band.

We claim:

1. A non-resonant broad band monopole antenna comprising:

a ground plane, a coaxial input line having a center conductor, and an outer shield which is connected to said ground plane below said ground plane, a fractional wavelength coaxial monopole antenna extending from said ground plane having a center conductor, and an outer radiator which is connected to said center conductor of said coaxial input line, said monopole antenna having an exposed ground plane portion and a tip portion, tip matching means coupled between the center conductor and the outer radiator of said coaxial antenna at the tip portion end remote from said ground plane, base matching means coupled between the center conductor of said coaxial antenna and said ground plane at the ground plane portion end of said coaxial antenna, and absorbing means covering a portion of said outer radiator of said coaxial monopole antenna remote from said ground plane, said absorbing means having a thickness which varies along the length of the antenna increasing in thickness toward said tip matching means, whereby said fractional wave length monopole antenna displays an equivalent infinite wavelength over a broad band of frequencies.

2. A non-resonant monopole antenna as set forth in claim 1 wherein said absorbing means comprises a tapered shape of microwave absorbing material.

3. A non-resonant monopole antenna as set forth in claim 2 wherein said tapered shape is cònical.

4. A non-resonant monopole antenna as set forth in claim 2 wherein said tapered shape is exponential.

5. A non-resonant monopole antenna as set forth in claim 1 wherein said microwave absorbing material is suspended in castable plastic.

6. A non-resonant monopole antenna as set forth in claim 1 wherein said absorbing material absorbs the high frequency signals which is coupled to the outer radiator of said coaxial monopole antenna before it reaches the tip matching means.

7. A non-resonant monopole antenna as set forth in claim 6 wherein said microwave absorbing material attenuates said high frequency signals from 5.6 decibels per centimeter to 63 decibels per centimeter in the frequency range of 1.5 gigahertz to 8.6 gigahertz.

8. A non-resonant monopole antenna as set forth in claim 7 wherein the length of said absorbing material is approximately ten inches and provides 20 decibels of attenuation at a frequency of 100 megahertz.

9. A non-resonant monopole antenna as set forth in claim 1 wherein said tip matching means and said base matching means together have an optimum impedence which is approximately equal to the characteristic impedence of the coaxial monopole antenna system.

10. A non-resonant monopole antenna as set forth in claim 9 wherein the characteristic impedence of said tip matching means is approximately equal to the characteristic impedence of said coaxial monopole antenna system.

11. A non-resonant monopole antenna as set forth in claim 9 wherein the characteristic impedence of said base matching means is approximately equal to the characteristic impedence of said coaxial monopole antenna system.

12. A non-resonant monopole antenna as set forth in claim 1 wherein the shape of said absorbing means comprises a plurality of different discontinuous geometric shapes.

13. A non-resonant monopole antenna as set forth in claim 12 wherein at least one of said plurality of geometric shapes is designed to attenuate a particular narrow range of high frequencies within said broad band of frequencies.

14. A non-resonant monopole antenna as set forth in claim 12 wherein said tip matching means is designed to attenuate a particular narrow range of low frequencies within said broad band of frequencies.

15. A non-resonant monopole antenna as set forth in claim 12 wherein said base matching means is designed to attenuate a particular range of frequencies within said broad band of frequencies.

16. A non-resonant monopole antenna as set forth in claim 1 wherein one of said tip matching means and said base matching means comprises a conductive lead connection.

17. A non-resonant monopole antenna as set forth in claim 16 wherein said tip matching means comprises a resistive element having a characteristic impedence matched to the characteristic impedence of the antenna system.

* * * * *